US009577377B1

(12) United States Patent
Lanzotti et al.

(10) Patent No.: US 9,577,377 B1
(45) Date of Patent: Feb. 21, 2017

(54) CONNECTOR ASSEMBLY WITH LEVER AND SHROUD

(71) Applicant: Sumitomo Wiring Systems, Ltd., Yokkaichi, Mie (JP)

(72) Inventors: Joseph Lanzotti, Grosse Pointe, MI (US); Alex Hsieh, Commerce Township, MI (US)

(73) Assignee: Sumitomo Wiring Systems, Ltd., Yokkaichi, Mie (JP)

( * ) Notice: Subject to any disclaimer, the term of this patent is extended or adjusted under 35 U.S.C. 154(b) by 0 days.

(21) Appl. No.: 14/992,647

(22) Filed: Jan. 11, 2016

(51) Int. Cl.
*H01R 13/62* (2006.01)
*H01R 13/629* (2006.01)
*H01R 9/05* (2006.01)

(52) U.S. Cl.
CPC ..... *H01R 13/62933* (2013.01); *H01R 9/05* (2013.01)

(58) Field of Classification Search
CPC ..... H01R 13/629; H01R 13/62933; H01R 13/62938; H01R 13/62955; H01R 13/62961; H01R 13/62966; H01R 9/05
USPC ..... 439/310, 157, 372
See application file for complete search history.

(56) References Cited

U.S. PATENT DOCUMENTS 2,487,801 A * 11/1949 Healy, Jr. ..... H01R 13/62 285/311
2,634,311 A * 4/1953 Darling ..... H01R 13/005 15/314
3,529,276 A * 9/1970 Hennessey, Jr. ..... H01R 13/627 439/310
4,303,292 A * 12/1981 McNeel ..... H01R 13/62933 439/152
4,840,574 A * 6/1989 Mills ..... B23K 9/323 439/157
4,891,016 A * 1/1990 Luzzi ..... H01R 13/53 439/183
4,998,884 A * 3/1991 Ishikawa ..... H01R 13/629 439/358
5,496,187 A * 3/1996 Shinchi ..... H01R 13/5219 439/157
5,857,868 A * 1/1999 Findon ..... H01R 13/6397 439/310
5,954,528 A * 9/1999 Ono ..... H01R 13/62972 439/152
6,273,756 B1 * 8/2001 Ward ..... H01R 13/6596 439/372

(Continued)

*Primary Examiner* — Tulsidas C Patel
*Assistant Examiner* — Travis Chambers
(74) *Attorney, Agent, or Firm* — Dinsmore & Shohl LLP

(57) ABSTRACT

A connector assembly for housing a coaxial connection and a terminal connection is provided. The connector assembly includes a male housing, a female housing and a lever configured to seat the male housing into the female housing at an angle. The male housing includes a first support configured to fixedly hold a first coaxial cable end. The female housing includes a second support configured to fixedly hold a second coaxial cable end. A shroud is disposed on a distal end of a second support. The inner surface of the shroud is configured to slidably engage an outer surface of the first support so as to guide the first coaxial cable end along an axis towards the second coaxial cable end, wherein the sliding engagement between the shroud and the first support overcome the angled approach as the male housing is seated into the female housing by actuation of the lever.

10 Claims, 6 Drawing Sheets

(56) References Cited

U.S. PATENT DOCUMENTS

| | | | | |
|---|---|---|---|---|
| 6,739,888 | B2 * | 5/2004 | Kato | B60L 3/00 439/157 |
| 6,945,797 | B2 * | 9/2005 | Obara | H01R 13/629 361/679.32 |
| 7,762,854 | B1 * | 7/2010 | Peng | H01R 13/508 439/578 |
| 7,905,742 | B2 * | 3/2011 | Wollitzer | H01R 13/625 439/157 |
| 8,651,883 | B2 * | 2/2014 | Becavin | H01R 13/6395 439/157 |
| 8,882,520 | B2 * | 11/2014 | Youtsey | H01R 4/26 439/157 |
| 9,028,163 | B2 * | 5/2015 | Advey | B60L 11/1818 403/322.4 |
| 2003/0017733 | A1 * | 1/2003 | Fujii | H01R 13/62938 439/157 |
| 2006/0178049 | A1 * | 8/2006 | Ishikawa | H01R 13/5219 439/587 |
| 2011/0189874 | A1 * | 8/2011 | Weidner | H01R 13/62 439/157 |
| 2012/0171890 | A1 * | 7/2012 | Kurachi | H01R 12/88 439/372 |
| 2016/0099509 | A1 * | 4/2016 | Hirota | H01R 13/743 439/578 |

* cited by examiner

CONNECTOR ASSEMBLY WITH LEVER AND SHROUD

FIELD OF THE INVENTION

The present invention is related to a connector assembly having a lever, the connector assembly configured to house a coaxial connection wherein the coaxial cables are approach each other along a common axis.

BACKGROUND OF THE INVENTION

Connector assemblies are currently known and used. Connector assemblies connect terminal ends of a cable or an electrical wire together so as to supply an electric signal from a source to a component. Connector assemblies include a male housing configured to be seated within a female housing.

Some connector assemblies include a lever configured to guide the male housing into the female housing and lock the male housing to the female housing. However, the actuation of the lever causes the male housing to approach the female housing at an angle. Thus, the connection between terminal ends of a cable may be compromised by the misalignment of one terminal end of a cable with respect to another terminal end of a cable.

Accordingly, it remains desirable to have a connector assembly, wherein the male housing unit is seated within the female housing unit at an angle, configured to guide the approach of one terminal end of a cable to the other terminal end of a cable along a common axis so as to help prevent the terminal ends of the cables from being misaligned.

SUMMARY OF THE INVENTION

A connector assembly for housing a coaxial connection and a terminal connection. The connector assembly includes a male housing, a female housing and a lever mechanically coupling the male housing to the female housing so as to guide the male housing into the female housing at an angle.

The male housing includes a first support. The first support is configured to fixedly hold a first coaxial cable end. The female housing is configured to receive the male housing. The female housing includes a second support. The second support is configured to fixedly hold a second coaxial cable end.

The connector assembly further includes a shroud disposed on a distal end of the second support. The shroud is configured to slidably engage an outer surface of the first support so as to guide the first coaxial cable end along an axis towards the second coaxial cable end.

Accordingly, the sliding engagement between the shroud and the first support overcome the angled approach as the male housing is seated into the female housing by actuation of the lever. Thus, the first coaxial cable end is axially aligned with the second coaxial cable end so as to help prevent the first coaxial cable end from being misaligned with the second coaxial cable end when the male housing is seated into the female housing.

BRIEF DESCRIPTION OF THE DRAWINGS

The embodiments set forth in the drawings are illustrative and exemplary in nature and not intended to limit the subject matter defined by the claims. The following detailed description of the illustrative embodiments can be better understood when read in conjunction with the following drawings where like structure is indicated with like reference numerals and in which:

DETAILED DESCRIPTION OF THE PREFERRED EMBODIMENTS

A connector assembly for housing a coaxial connection and a terminal connection is provided. The connector assembly includes a male housing, a female housing and a lever mechanically coupling the male housing to the female housing so as to guide the male housing into the female housing at an angle.

The male housing includes a first support configured to fixedly hold the first coaxial cable end. The female housing includes a second support configured to fixedly hold the second coaxial cable end. The connector assembly is configured to guide the first coaxial cable end along an axis towards the second coaxial cable end. Accordingly, the sliding engagement between the shroud and the first support overcome the angled approach as the male housing is seated into the female housing by actuation of the lever. Thus, the first coaxial cable end is axially aligned with the second coaxial cable end so as to help prevent the first coaxial cable end from being misaligned with the second coaxial cable end when the male housing is seated into the female housing.

Figure 1:
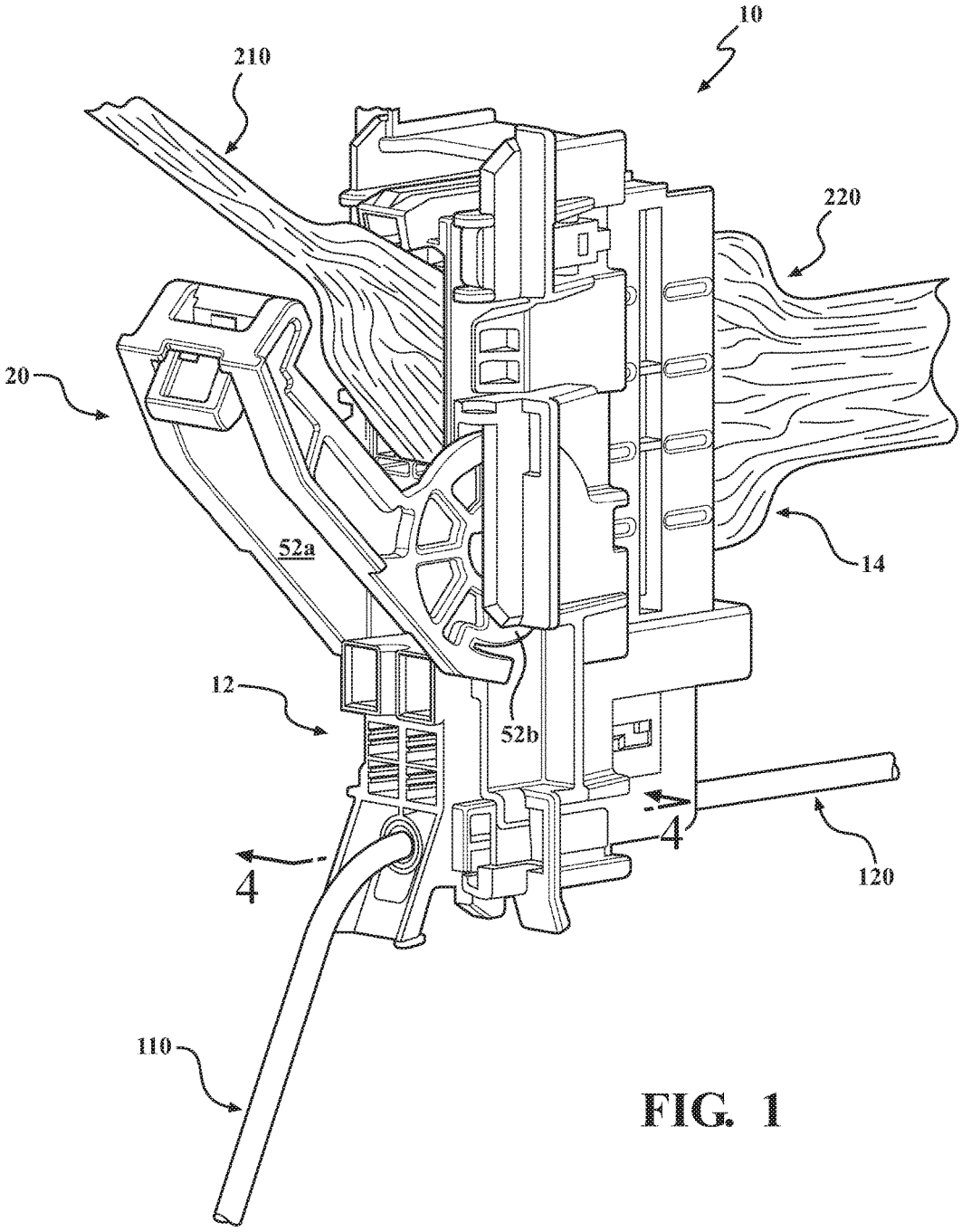
FIG. 1 is a perspective view showing the connector assembly assembled.
Figure 6:
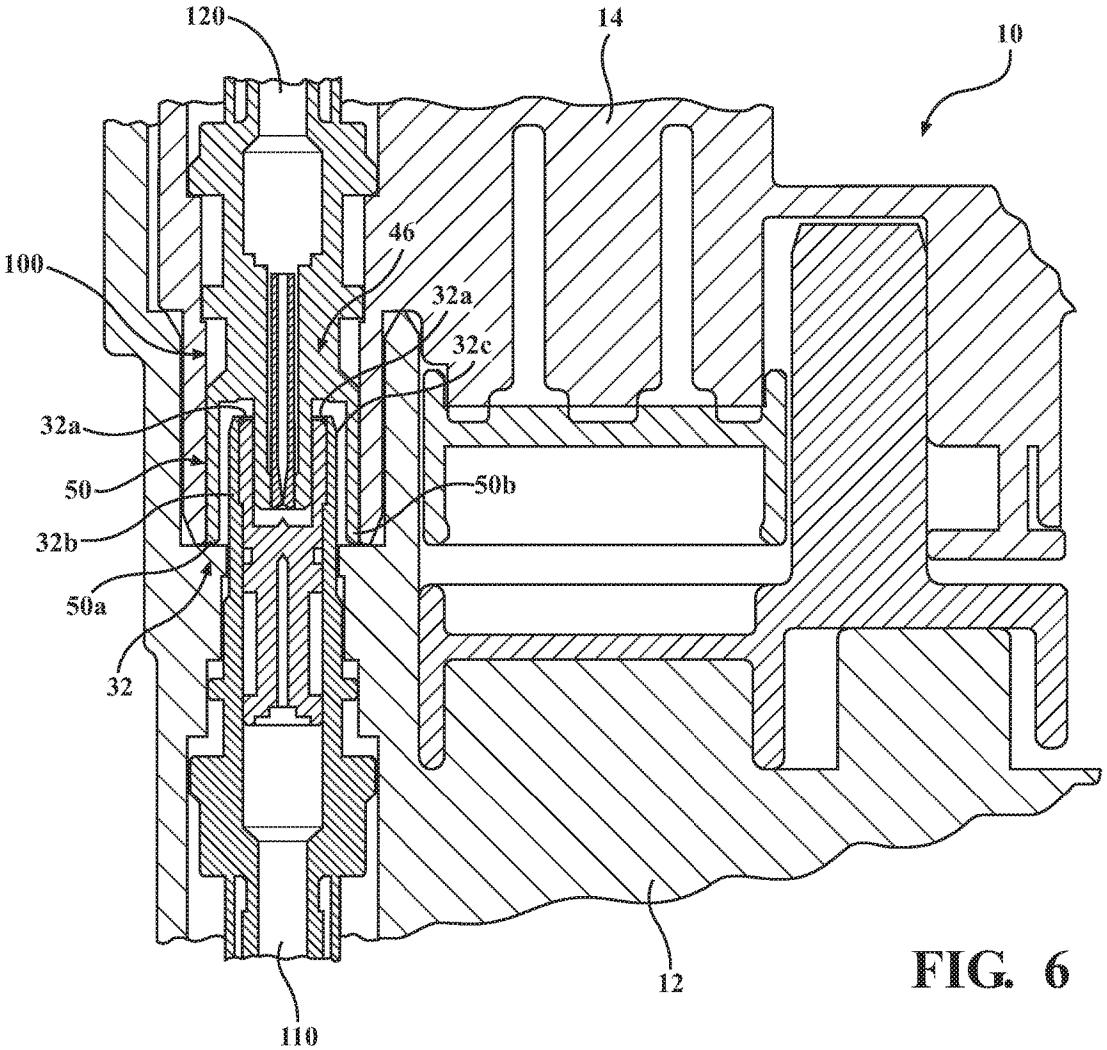
FIG. 6 is a cross-sectional view of FIG. 1 taken along lines 6-6.

With reference now to FIGS. 1 and 6 an illustrative view of a connector assembly 10 is provided. The connector assembly 10 is configured to house a coaxial connection 100 and a terminal connection 200. The connector assembly 10 includes a male housing 12 configured to be seated within a female housing 14 wherein a coaxial connection 100 and a terminal connection 200 formed between ends 16, 18 of first and second coaxial cables 110, 120 and the ends of the first and second terminal wires 210, 220. The connector assembly 10 includes a lever 20. The lever 20 mechanically couples the male housing 12 to the female housing 14. The lever 20 is further configured to guide the male housing 12 into the female housing 14 at an angle.

Figure 2:
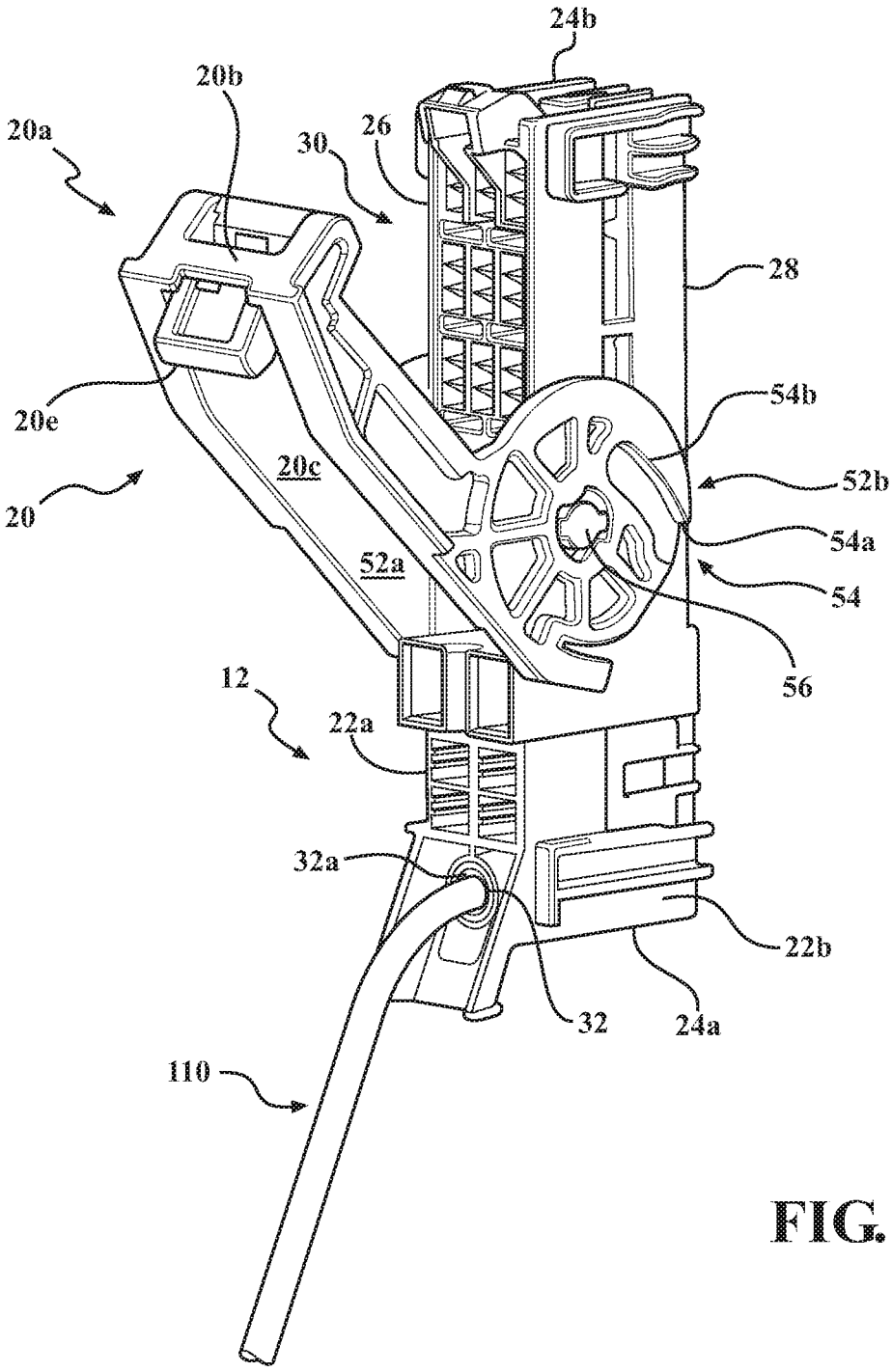
FIG. 2 is a perspective view showing the male housing.
Figure 4:
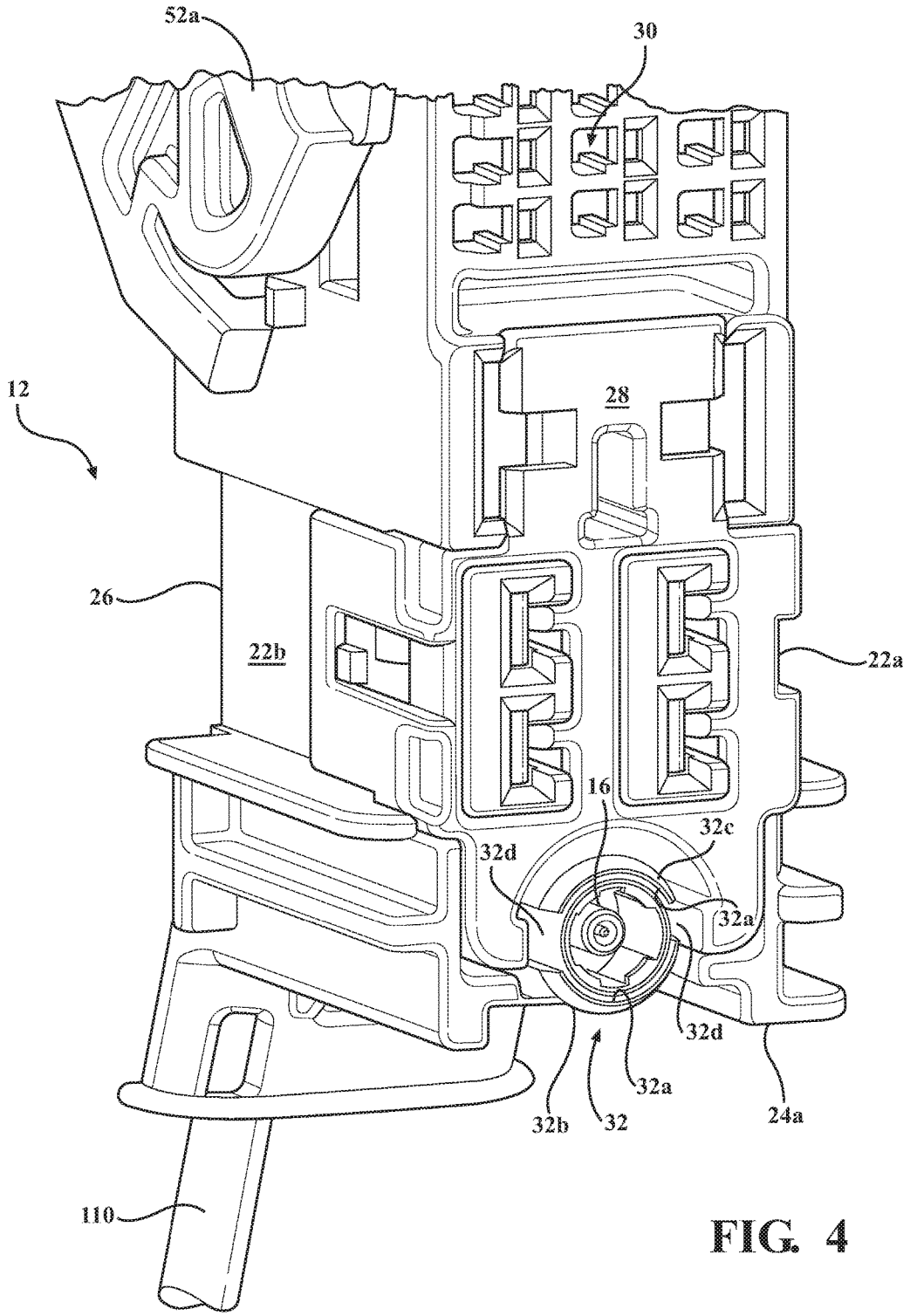
FIG. 4 is an isolated view showing the first support of the male housing.

With reference now to FIGS. 2 and 4, an illustrative view of the male housing 12 is provided. The male housing 12 is a generally rectangular shaped member defined by a pair of first side walls 22*a*, 22*b*, a pair of first end walls 24*a*, 24*b*, a first top wall 26 and a first bottom wall 28. The male housing 12 may be formed of a resilient and durable material such as a polypropylene.

The male housing 12 may include a plurality of first terminal cavities 30 configured to hold the terminal ends (not shown) of respective wires forming the terminal connection 200. The male housing 12 further includes a first support 32. The first support 32 is disposed on the first bottom wall 28 of the male housing 12 and is configured to fixedly hold a first coaxial cable end 16.

Figure 3:
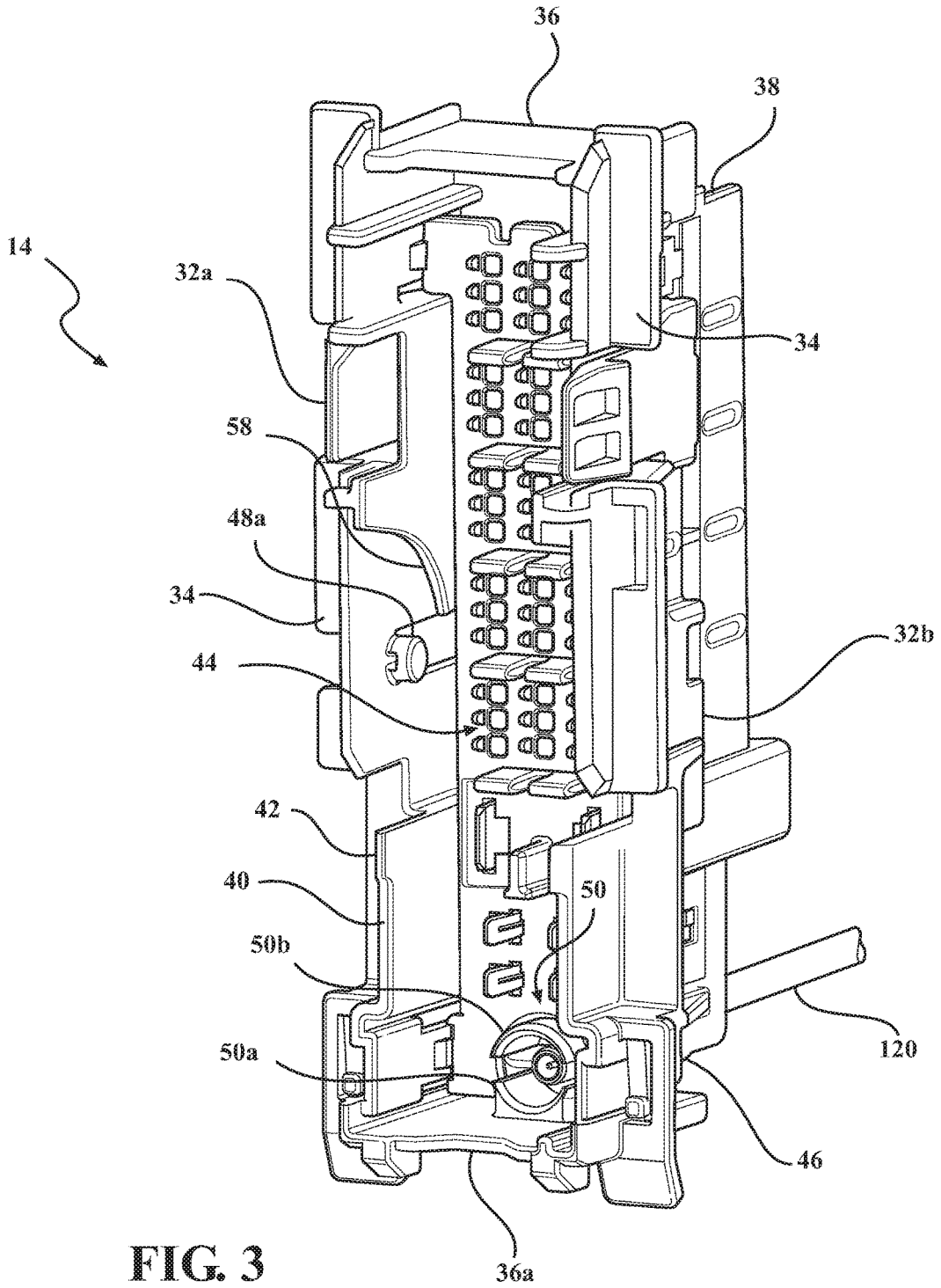
FIG. 3 is a perspective view showing the female housing.
Figure 5:
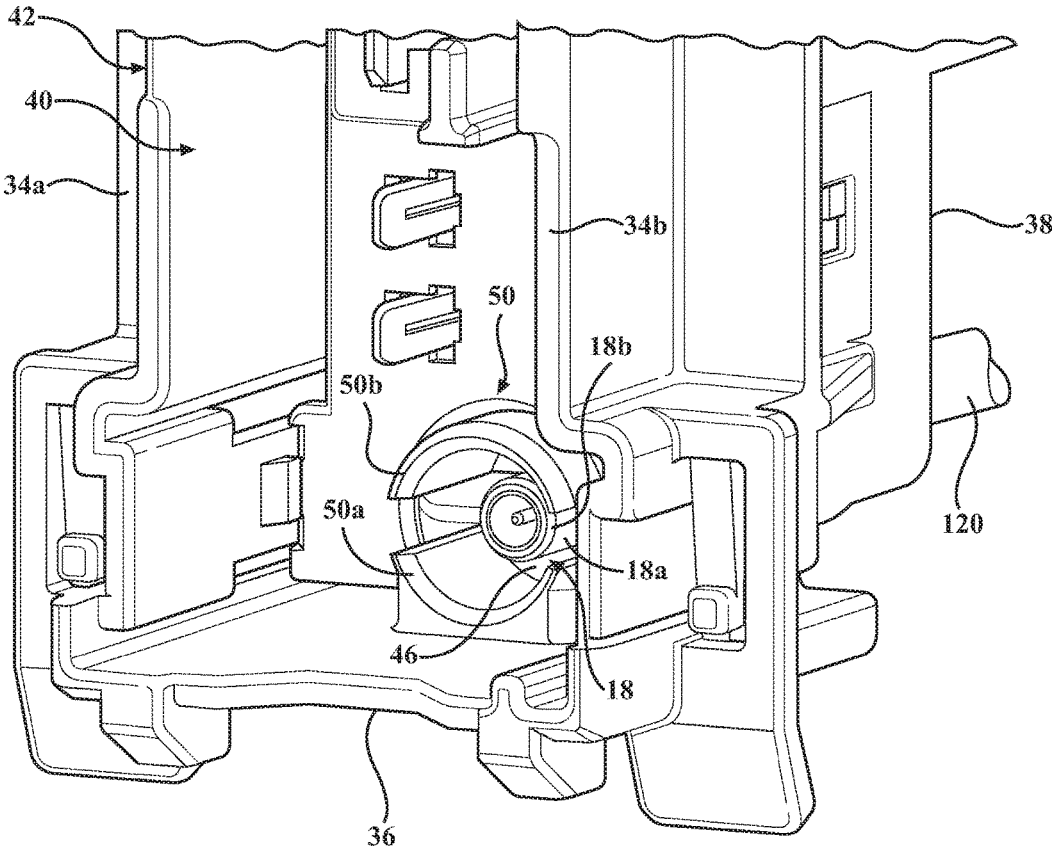
FIG. 5 is an isolated view showing the second support and shroud of the female housing.

With reference now to FIGS. 3 and 5, an illustrative view of the female housing 14 is provided. The female housing 14 is a generally rectangular shaped member having a pair of second side walls 34, a pair of second end walls 36*a*, 36*b* and a second bottom wall 38 so as to define a cavity 40 and a top opening 42. The female housing 14 may be formed of a resilient and durable material such as a polypropylene. The female housing 14 may further include a plurality of second terminal cavities 44 corresponding to a respective one of the first terminal cavities 30 of the male housing 12 so as to form a terminal connection 200 when the male housing 12 is seated within the female housing 14.

The female housing 14 is configured to receive the male housing 12, as shown in FIG. 1. With reference again to FIG. 3, the female housing 14 includes a second support 46. The second support 46 is disposed on the second bottom wall 38. The second support 46 is configured to fixedly hold a second coaxial cable end 18. The female housing 14 includes a first pin 48*a* and a second pin 48*b* disposed on opposing inner surfaces of a respective second side wall 34*a*, 34*b*. It should be appreciated that even though only the first pin 48*a* is visible in FIG. 3, the second pin 48*b* is directly across from the first pin 48*a* and is nearly identical in physical dimensions.

With reference again to FIGS. 3, 5 and 6, the connector assembly 10 further includes a shroud 50. The shroud 50 is disposed on a distal end of the second support 46. The shroud 50 is configured to slidably engage an outer surface of the first support 32 so as to guide the first coaxial cable end 16 along an axis towards the second coaxial cable end 18, wherein the sliding engagement between the shroud 50 and the first support 32 overcome the angled approach as the male housing 12 is seated into the female housing 14 by actuation of the lever 20.

With reference again to FIG. 2, the lever 20 is illustratively shown rotatably mounted to the male housing 12. The lever 20 includes a wheel 52*a*/52*b* having a groove 54 disposed on the outer surface of the wheel 52*a*/52*b*. The groove 54 follows an arcuate path and includes a groove opening 54*a*. The groove opening 54*a* is configured to receive a pin disposed on the inner surface of the second side wall of the female housing 14.

FIG. 2 shows the lever 20 having a first wheel 52*a* opposite a second wheel 52*b*. Although only the outer surface of first wheel 52*a* is shown, it should be appreciated that the outer surface of the second wheel 52*b* is identical to the outer surface of the first wheel 52*a*, and thus a description of the first wheel 52*a* is sufficient to describe the second wheel 52*b*.

The first wheel 52*a* and second wheel 52*b* are rotatably disposed to a pivot pin 56 which may extend through the width of the male housing 12. The first and second wheels 52*a*, 52*b* are rotatably disposed on the outer surface of respective first side walls 22*a*, 22*b* of the male housing 12.

The first and second wheels 52*a*, 52*b* are further configured to slide along a shoulder 58 (shown in FIG. 3) disposed on respective inner wall surfaces of the second side walls 34*a*, 34*b* of the female housing 14. The shoulders 58 define a ledge following an arcuate path so as to facilitate rotation of the first and second wheels 52*a*, 52*b*.

The lever 20 includes a handle 20*a*. The handle 20*a* includes a cross-member 20*b* and a pair of stems 20*c*, 20*d* interconnecting the sides of the cross-member 20*b* to a respective first and second wheels 52*a*, 52*b*. The handle may further include an actuator 20*e* configured to release the lever 20 from a locked position.

The handle 20*a* interconnects the first wheel 52*a* to the second wheel 52*b* so as to rotate the first and second wheels 52*a*, 52*b* simultaneously. The actuator 20*e* may be pulled so as to free the first and second wheels 52*a*, 52*b* so as to allow the user to push the lever 20 down, wherein the first and second pins 48*a*, 48*b* disposed on respective inner wall surfaces of the second side wall 34*a*, 34*b* are fed into the groove opening 54*a* and guided along the groove 54 to the end wall 54*b* of the groove 54. As the first and second pins 48*a*, 48*b* travel along respective grooves 54, the male housing 12 closes in on the female housing 14 at an angle.

With reference now to FIGS. 4-6, an illustrative view of the first support 32, second support 46 and the shroud 50 are provided. The first coaxial cable end 16 has an outer surface 16*a*. The first support 32 has an inner surface 32*a*, the inner surface 32*a* of the first support 32 is pressed flush against the outer surface 16*a* of the first coaxial cable end 16. The first support 32 includes a pair of elongated members 32*b*, 32*c*. The elongated members 32*b*, 32*c* are spaced apart from the other and have a C-shaped cross-section so as to form a generally cylindrical tube having an open end and a pair of slots 32*d*. The slots 32*d* are opposite of each other and extend along an axial length of the first support 32. Each of the pair of elongated members 32*b*, 32*c* are configured to engage opposing sides of the first coaxial cable end 16.

The second support 46 is generally a cylindrical tube configured to fittingly hold a neck 18*a* of the second coaxial cable end 18, wherein a free end 18*b* of the second coaxial cable end 18 projects axially from the open end of the second support 46. The shroud 50 extends axially from the second support 46 and bounds the free end 18*b* of the second coaxial cable and 18. The shroud 50 extends beyond the free end 18*b* of the second coaxial cable end 18 such that the free end 18*b* of the second coaxial cable end 18 is recessed within the shroud 50.

The shroud 50 may include a pair of lips 50*a*, 50*b*, each of the pair of lips 50*a*, 50*b* spaced apart from the other. The pair of lips 50*a*, 50*b* have a C-shaped cross-section and are generally concentric to a corresponding one of the pair of elongated members 32*b*, 32*c* of the first support 32. The pair of lips 50*a*, 50*b* are spaced apart from each other so as to slidingly receive the first support 32 between the pair of lips 50*a*, 50*b*.

The shroud 50 is configured to guide the first coaxial cable end 16 and the second coaxial cable end 18 towards each other along a common axis so as to prevent the first and second coaxial cable ends 16, 18 from being misaligned with respect to each other. As the male housing 12 is seated within the female housing 14, the shroud 50 receives the first support 32. In particular, the inner surface of the shroud 50 slidingly receives the outer surface of the first support 32 so as to move the first coaxial cable end 16 towards the second coaxial cable end 18 along an axis. Thus, misalignment between the first and second coaxial cable ends 16, 18 is prevented despite the fact that the male housing 12 is seated within the female housing 14 at an angle.

While particular embodiments have been illustrated and described herein, it should be understood that various other changes and modifications may be made without departing from the spirit and scope of the claimed subject matter. Moreover, although various aspects of the claimed subject matter have been described herein, such aspects need not be utilized in combination.

We claim:

1. A connector assembly for housing a coaxial connections and terminal connections, the connector assembly comprising:

a male housing having a first support, the first support fixedly holding a first coaxial cable end;

a female housing configured to receive the male housing, the female housing having a second support, the second support fixedly holding a second coaxial cable end, the female housing further including a side wall having an inner surface and a first pin;

a lever mechanically coupling the male housing to the female housing, the lever guiding the male housing into the female housing at an angle, lever includes a first wheel having a groove, the groove following an arcuate path, wherein the first pin of the female housing is configured to follow the arcuate path of the groove; and a shroud disposed on a distal end of the second support, the shroud configured to slidably engage an outer surface of the first support so as to guide the first coaxial cable end along an axis towards the second coaxial cable end, wherein a sliding engagement between the shroud and the first support overcome an angled approach as the male housing is seated into the female housing by actuation of the lever.

2. The connector assembly as set forth in claim 1, wherein the first coaxial cable end has an outer surface, and wherein the first support has an inner surface, the inner surface of the first support is pressed flush against the outer surface of the first coaxial cable end.

3. The connector assembly as set forth in claim 2, wherein the first support includes a pair of elongated members, each of the pair of elongated members are spaced apart from the other and have a C-shaped cross-section, each of the pair of elongated members engaging opposing sides of the first coaxial cable end.

4. The connector assembly as set forth in claim 3, wherein the shroud includes a pair of lips, each of the pair of lips spaced apart from the other, the pair of lips having a C-shaped cross-section and concentric to a corresponding one of the pair of elongated members so as to slidingly receive the first support between the pair of lips.

5. The connector assembly as set forth in claim 4, wherein the lever further includes a second wheel having a groove and a handle, the male housing includes a first side wall opposite a second side wall, the first wheel rotatably disposed on the first side wall of the male housing the second wheel rotatably disposed on the second side wall of the male housing, the handle interconnecting the first wheel to the second wheel so as to rotate the first and second wheel simultaneously, and wherein the female housing includes a first inner wall surface opposite a second inner wall surface, the first pin is disposed on the first inner wall surface and a second pin is disposed on the second inner wall surface, the first pin and the second pin configured to travel along corresponding grooves so as to seat the male housing within the female housing when the handle is engaged.

6. A connector assembly for housing a coaxial connection and a terminal connection, the connector assembly comprising:

a male housing having a lever and a first support, the first support fixedly holding a first coaxial cable end, the lever includes a first wheel having a groove, the groove following an arcuate path, wherein the first pin of the female housing is configured to follow the arcuate path of the groove;

a female housing configured to receive the male housing, the female housing having a second support, the second support fixedly holding a second coaxial cable end, the lever mechanically coupling the male housing to the female housing so as to guide the male housing into the female housing at an angle, the female housing further including a side wall having an inner surface and a first pin; and a shroud disposed on a distal end of the second support, an inner surface of the shroud is configured to engage the outer surface of the first support so as to slidably engage the outer surface of the first support so as to guide the first coaxial cable end along an axis towards the second coaxial cable end, wherein a sliding engagement between the shroud and the first support overcome an angled approach as the male housing is seated into the female housing by actuation of the lever.

7. The connector assembly as set forth in claim 6, wherein the first coaxial cable end has an outer surface, and wherein the first support has an inner surface, the inner surface of the first support is pressed flush against the outer surface of the first coaxial cable end.

8. The connector assembly as set forth in claim 7, wherein the first support includes a pair of elongated members, each of the pair of elongated members are spaced apart from the other and have a C-shaped cross-section, each of the pair of elongated members engaging opposing sides of the first coaxial cable end.

9. The connector assembly as set forth in claim 8, wherein the shroud includes a pair of lips, each of the pair of lips spaced apart from the other, the pair of lips having a C-shaped cross-section and concentric to a corresponding one of the pair of elongated members so as to slidingly receive the first support between the pair of lips.

10. The connector assembly as set forth in claim 9, wherein the lever further includes a second wheel having a groove and a handle, the male housing includes a first side wall opposite a second side wall, the first wheel rotatably disposed on the first side wall of the male housing, the second wheel rotatably disposed on the second side wall of the male housing, the handle interconnecting the first wheel to the second wheel so as to rotate the first and second wheel simultaneously, and wherein the female housing includes a first inner wall surface opposite a second inner wall surface, the first pin is disposed on the first inner wall surface and a second pin is disposed on the second inner wall surface, the first pin and the second pin configured to travel along corresponding grooves so as to seat the male housing within the female housing when the handle is engaged.

* * * * *